United States Patent [19]

Sanderson

[11] 3,983,473

[45] Sept. 28, 1976

[54] SERIES DIRECT-CURRENT VOLTAGE REGULATOR

[75] Inventor: Albert E. Sanderson, Carlisle, Mass.

[73] Assignee: Inventronics, Inc., Carlisle, Mass.

[22] Filed: May 6, 1974

[21] Appl. No.: 466,992

[52] U.S. Cl. ..... 323/22 R; 323/25

[51] Int. Cl.[2] ..... G05F 1/58

[58] Field of Search ..... 307/24, 33, 34, 55, 307/77, 296, 297, 304; 317/20; 323/16, 19, 22 R, 22 T, 23, 25, 38

[56] References Cited

UNITED STATES PATENTS

| | | | |
|---|---|---|---|
| 2,698,416 | 12/1954 | Sherr | 323/22 T |
| 3,069,617 | 12/1962 | Mohler | 323/22 T |
| 3,102,183 | 8/1963 | Harrison | 323/22 T |
| 3,300,709 | 1/1967 | Short et al. | 323/22 T |
| 3,571,604 | 3/1971 | Porta et al. | 323/22 T |
| 3,831,040 | 8/1974 | Nanba et al. | 307/297 X |

FOREIGN PATENTS OR APPLICATIONS

| | | | |
|---|---|---|---|
| 1,438,982 | 12/1968 | Germany | 323/22 T |
| 1,954,430 | 5/1971 | Germany | 323/22 T |
| 1,963,650 | 6/1971 | Germany | 323/19 |

OTHER PUBLICATIONS

Wu, "Designing Power Supplies with FETS" EEE vol. 16 No. 12 Dec. 1968, pp. 68, 69.

*Primary Examiner*—A. D. Pellinen
*Attorney, Agent, or Firm*—Cesari and McKenna

[57] ABSTRACT

A series direct-current voltage regulator. The regulator comprises a field effect transistor as a series regulating element and a reference element comprising a forward-biased PN junction.

4 Claims, 4 Drawing Figures

SERIES DIRECT-CURRENT VOLTAGE REGULATOR

BACKGROUND OF THE INVENTION

This invention generally relates to voltage regulator circuits and more specifically to voltage regulator circuits using solid-state components as series voltage regulating elements.

In recent years many battery-operated electronic devices have appeared on the marketplace. Some of these electronic devices require a voltage regulator to control the voltage supplied to various circuits so that they operate properly. Typically, a regulator comprises a series regulating element, a reference element, a comparison element, and a control element. The comparison element compares the reference voltage from the reference element to the regulated output voltage and provides an error signal corresponding to any difference between the two. The control element responds to the error signal by controlling the series regulating element to minimize the error signal.

Zener diodes are commonly used as reference elements. They maintain a fairly constant reference voltage level. However, a zener diode normally draws a minimum specified current, normally about 20 milliamperes. This is unduly wasteful for use with a load device that itself requires only a fraction as much current, particularly when the power source is a small battery which can supply only a fixed amount of energy.

The comparison and control elements may also require considerable current to operate properly. This further introduces an unnecessary energy requirement on the relatively small, fixed amount available from the battery.

Both vacuum tubes and transistors serve as the series regulating element in voltage regulators. Vacuum tubes require that the unregulated voltage be kept significantly higher than the regulated voltage in order to keep the tube conducting. Even with transistors, it is necessary to maintain a one-half volt or greater potential between the emitter electrode and the base and collector electrodes. This is normally accomplished by coupling the base electrode to the collector electrode which normally connects to the unregulated d-c power source potential. If this potential on the base-emitter junction and emitter-collector circuit is not maintained, transistors stop conducting. In circuits using batteries as the d-c power source, this requirement can foreshorten the effective battery life because a battery must then be replaced considerably before its useful output voltage is reduced to the regulated voltage (i.e., when its voltage is still 0.6 volt above the regulated voltage.)

Therefore, it is an object of this invention to provide a series voltage regulator which is especially adapted for use in battery-operated circuits.

Another object of this invention is to provide a voltage regulator in which a minimum voltage appearing across a series regulating element is reduced.

Still another object of this invention is to provide a voltage regulator in which the energy for operating the reference, comparison and control circuits is significantly reduced.

SUMMARY

In accordance with this invention, a field effect transistor performs the series regulating function in the voltage regulator. The reference element includes the PN junction of a transistor and the voltage across this junction is a reference voltage. The junction is supplied through circuitry connected to the regulated output voltage. A collector resistor for the transistor, connected between the source and gate electrodes of the field effect transistor, controls the source-to-gate voltage.

This regulator has two basic operating regions. Above a pinch-off voltage, the field effect transistor, for given operating conditions, inherently regulates the output current to a constant value for a wide range of input voltages. When the source-to-drain voltage decreases below the pinch-off voltage, any tendency to vary the regulated output voltage causes the collector resistor voltage to vary the source-to-gate voltage of the field effect transistor and thereby alter the operating conditions including the conduction of the field effect transistor.

This invention is pointed out with particularity in the appended claims. A more thorough understanding of the above and further objects of this invention may be attained by referring to the following description taken in conjunction with the accompanying drawings.

DESCRIPTION OF AN ILLUSTRATIVE EMBODIMENT

Figure 1:
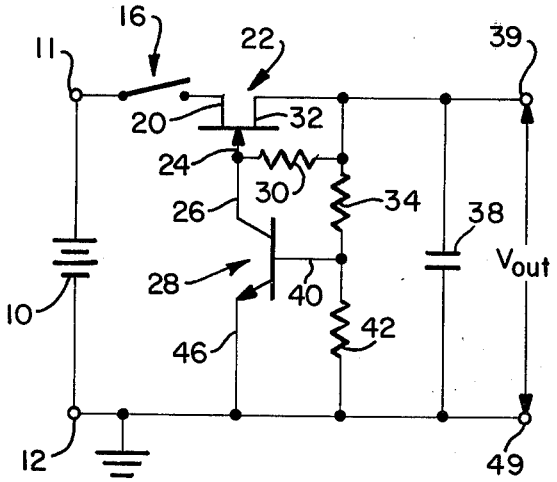
FIG. 1 is a schematic diagram of one embodiment of a voltage regulator constructed in accordance with this invention.

Referring to FIG. 1, a power supply in the form of a direct-current voltage source, such as a conventional battery 10, has a positive terminal which connects to an input terminal 11 and a negative terminal which connects to another input terminal 12. The terminal 11 connects, through a switch 16, to a drain electrode 20 of an N-type depletion field effect transistor 22. As known, source and drain electrodes define a variable resistance current path in a field effect transistor; the voltage between the source and gate electrodes controls the resistance of the current path. A gate electrode 24 connects to a collector-emitter current path including the collector 26 of an NPN transistor 28 and to one end of a collector resistor 30 from a source electrode 32 and one output terminal 39. A resistor 34 and a resistor 42 constitute a voltage divider and a junction of resistors 34 and 42 is a tap connection which provides a base-emitter current path including a diode junction with an anode connected to the base electrode 40 of the NPN transistor 28 with its input current. The resistor 42 and the emitter electrode 46 of the transistor 28 also connect to a common terminal formed by a common conductor between the input terminal 12 and another output terminal 49. This common terminal is normally grounded.

Figure 2:
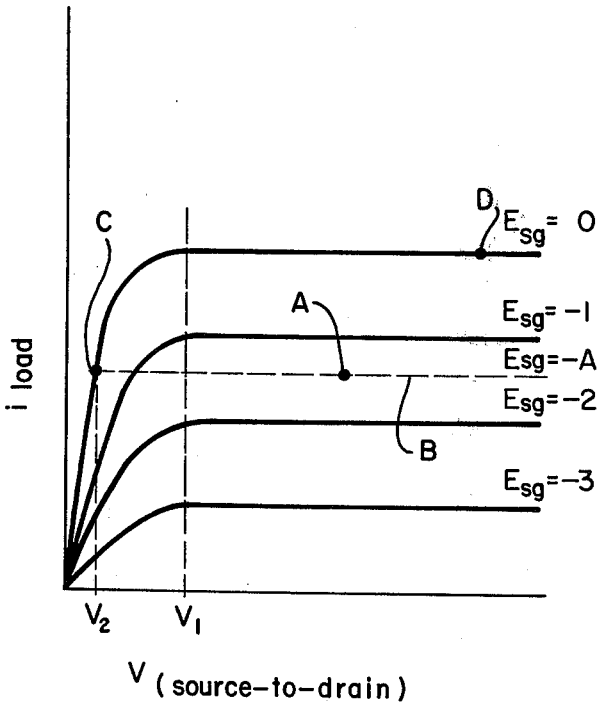
FIG. 2 depicts characteristic operating curves for a typical field effect transistor.

The operation of the circuit in FIG. 1 may be more readily understood by referring also to FIG. 2 which depicts characteristic operating curves for a typical N-type depletion field effect transistor. FIG. 2 is characterized by being divided into two sections defined by a source-to-drain voltage $V_1$ which is the voltage at the drain electrode measured with respect to the voltage at the source electrode and which is the "pinch-off" voltage. Likewise, the source-to-gate voltage represents the voltage at the gate electrode with respect to the voltage at the source electrode. So long as the source-to-drain voltage exceeds $V_1$, load current remains substantially constant for any variations in the source-to-drain voltage. If the source-to-drain voltage falls below $V_1$, the load current for a given source-to-gate voltage decreases. As can be seen by inspection of FIG. 1, the gate electrode 24 will not be positive with respect to the source electrode 32 in normal operation.

Now considering the operation of the regulator in FIG. 1, in a situation where the output voltage from the battery 10 or other potential source varies, the regulator normally operates above the pinch-off voltage. Assuming that the reference, comparison and control circuits establish a normal operating point "A" in FIG. 2, wide variations in the source-to-drain voltage (i.e., caused by the output voltage of the battery 10) are inherently regulated by the field effect transistor 22. The changes in conductivity of the field effect transistor are made without changing the source-to-gate voltage. As the source-to-gate voltage is constant, the current which is established by the collector resistor 30 is constant so the collector resistor acts as a constant current source to the collector emitter path and is the sole source of current to that path.

When the battery voltage reduces and the source-to-drain voltage becomes less than $V_1$, the regulator in FIG. 1 operates below the pinch-off voltage. Any tendency to reduce the output voltage ($V_{out}$) tends to decrease current through the collector resistor 30. Any reduction in the current would reduce the source-to-gate voltage and increase the conductivity through the field effect transistor 22 thereby increasing the load voltage $V_{out}$. As an increase in the output voltage ($V_{out}$) would produce a reverse effect by decreasing the source-to-gate voltage, the regulator maintains the load current ($i_{load}$) and the output voltage at a constant load represented by the dashed line B. At some point, however, the battery voltage reduces to a level at which the source-to-gate voltage is zero ($E_{sg}=0$). This condition is point C in FIG. 2 and represents a source-to-drain voltage $V_2$. This is the minimum voltage drop across the field effect transistor 22 which still enables the regulator circuit to operate. Whereas this voltage is about 0.6 volts in a regulator using a transistor as the series regulating element, it can be much less for many depletion field effect transistors. It is determined by the load current and the internal resistance of the field effect transistor at zero source-to-gate voltage. This can be 10 ohms or less, and the $V_2$ for a 5mA power supply can be 0.05 volts or less. Thus, the regulator in FIG. 1 operates through a wider range of input voltages and reduces the minimum allowable input voltage. This allows a battery to be used longer and effectively increases battery life.

Any change in load current tends to alter the source-to-gate voltage $E_{sg}$ in the regulator. For example, a decrease in the load tends to increase the output voltage. However, if such an increase did occur, the base current to the transistor 28 and the current through the collector resistor 30 would also increase and establish an operating point below the load line B. Likewise, any increase in the load tends to reduce the output voltage. However, such a reduction would decrease the base current to the transistor 28 and the current through the collector resistor 30 and establish a new operating point at a higher load current.

Under normal operations, no ripple voltage from the power supply appears at the output terminals 39 and 49. A capacitor 38 may be added to eliminate any ripple voltage a load such as a periodic discharge device might introduce.

Referring to FIGS. 1 and 2, in any specific application the maximum source-to-drain voltage, the regulated output voltage and load current determine which of the many field effect transistors will be used. Then a set of curves, analogous to those in FIG. 2 for the selected transistor, are used to determine the operating point A in FIG. 2.

If load short-circuit protection is desirable, another consideration in selecting a field effect transistor is the load current when the source-to-gate voltage is zero ($E_{sg}=0$). If the output terminals 39 and 49 in FIG. 1 are shorted, the source-to-gate voltage goes to zero. This effectively increases the source-to-drain voltage and the operating point moves to some point, such as D in FIG. 2 on the $E_{sg}=0$ curve. Thus, the regulator in FIG. 1 limits short circuit current.

After selecting the field effect transistor 22, the transistor 28 is selected. This transistor should exhibit a relatively high beta at low collector current and operate with a collector current of a few microamperes.

At the operating point A, the resistor 30 is selected so that the current therethrough will be much greater than the leakage current. Thus, given the leakage current and multiplying that current by a factor of 100 or more to obtain the current $i_c$, the value of the collector resistor is $R_{30} = E_{sg}-(A)/i_c$ where $E_{sg}=(A)$ is the source-to-gate voltage required to obtain operating point A.

During operation the current through the resistor 42 should be ten or more times greater than the base current to the transistor 28. In one example, the base current of the transistor 28 is 0.1 microamperes, and the current to the resistor 42 (i.e., $i_{42}$) is about 10 microamperes. At this base current, the voltage across the base-emitter junction of transistor 28 (i.e., $V_{be}$) is about 0.5 volts. Thus, the value of the resistor 42 is $R_{42} = 0.5/i_{42}$. Once the resistor 42 is chosen, the value of the resistor 34 is:

$$R_{34} = R_{42}\,[(V_{out}/V_{be})-1] \qquad (1)$$

As $V_{be} \cong 0.5$ volts, $R_{34} \cong R_{42}\,(2V_o - 1)$ provides a close approximation of the value of $R_{34}$.

There are now commercially available two types of field effect transistors. These are characterized as "junction" and "isolated gate" field effect transistors. Isolated gate field effect transistors are also known as MOS field effect transistors. Only the junction field effect transistors can be used in this regulator. As described later, with respect to FIG. 4, junction field effect transistors are further catagorized as "positive" or P channel and "negative" or "N-channel" junction field effect transistors. This voltage regulator works equally well with both types of junction field effect transistors. If an N-channel type, the source-to-gate voltage is a controlling voltage and must be kept negative. In a P-channel type, the source-to-gate voltage is also the controlling voltage and is kept positive.

In the circuit in FIG. 1, the output voltage from the regulator is determined by $$V_{out} = V_{be} [(R_{42} + R_{34})/R_{42}] \quad (2)$$

Although the resistance can be made insensitive to temperature variations, the base-to-emitter voltage ($V_{be}$) in the transistor 28 does vary with changes in the temperature. In many applications, the regulated voltage variations with temperature may be within acceptable limits or even not be an important factor. In other situations, such a variation may be desirable; and, in fact, the circuit of FIG. 1, when the base-to-emitter junction is driven with a constant current source, can serve as a temperature transducer.

Equations (3) and (4) describe the current (I) and the saturation current ($I_r$) through a diode in the base-emitter junction.

$$I = I_r [\exp(qV/nkT) - 1] \quad (3)$$

$$I_r = aT^3 \exp(E_g/kT) \quad (4)$$

where

*q* is the charge on an electron;
V is the voltage across the base-emitter junction;
*n* is a constant for a given operating condition;
*k* is Boltzmann's constant;
T is the temperature in degrees Kelvin;
*a* is a constant; and
$E_g$ is the energy gap across the diode junction in ergs.

As the term exp(qV/kT) is much greater than 1, equation (3) can be written as:

$$I = I_r \exp(qV/kT) \quad (5)$$

If equation (4) is substituted in equation (5) and the resulting equation is solved for V, then $$V = (nE_g/q) - (3nkT/q) \ln (TI/a) \quad (6)$$

For a given diode energized by a constant current source, $$C1 = nE_g/q \quad (7)$$

$$C2 = 3nk/q \quad (8)$$

$$C3 = I/a \quad (9)$$

so equation (6) has the form $$V = C_1 - C_2 T \ln (C_3 T) \quad (10)$$

The natural logarithm of the temperature varies relatively slowly, with respect to temperature, so in many applications equation (10) can be replaced by $$V = C_1 - C_2 T K \text{ where } K = \ln (C_3) \quad (11)$$

Thus, given a high transconductance FET, the current through $R_{30}$ and the collector-emitter current path and therefore the emitter current of the transistor 28 is relatively constant. The base-emitter voltage drop, which is a diode drop, alters the output voltage, $V_{out}$, as a function of temperature. Thus, the circuit acts as a temperature transducer.

Figure 3:
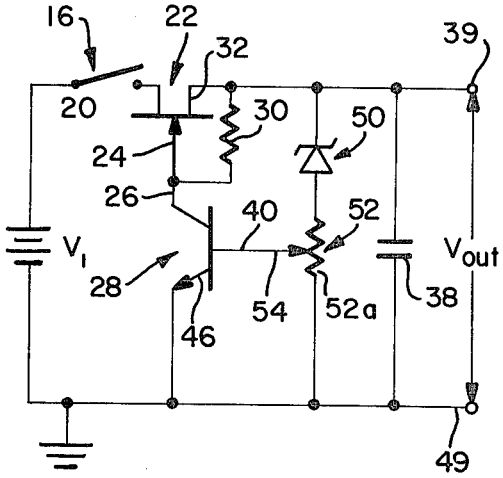
FIG. 3 is a schematic diagram of another embodiment of a voltage regulator constructed in accordance with this invention which is relatively insensitive to temperature variations.

If the temperature induced variations in the output voltage must be held within reasonably close limits, the circuit of FIG. 1 can be modified by removing resistor 34 and adding a zener diode 50 between the tap connection of the voltage divider and the output terminal 39. As shown in FIG. 3, a potentiometer 52 serves as the voltage divider with the zener diode 50 in place of resistor 34 in FIG. 1. A wiper arm 54 is the tap connection and connects to the base electrode 40 of the transistor 28. Assuming that $R_{52a}$ defines a resistance between the wiper arm 54 and the common output terminal 49, the output voltage is:

$$V_{out} = V_{zener} + V_{be} (R_{52}/R_{52a}) \quad (12)$$

where $V_{zener}$ is the voltage of the zener diode 50. As can be seen from the formula, $V_{out}$ can be varied with $R_{52a}$ over a range to compensate for tolerance variations in zener diode voltage, $V_{zener}$. For a given change in temperature, the baseemitter voltage of the transistor 28 varies much more than the zener voltage. Furthermore, as $V_{out}$ is constant, the zener diode 50 can be chosen so that it effectively "swamps out" the base-emitter junction voltage variations due to temperature. Consider, for example, that a regulator is to be constructed such that $V_{out} = 5$ volts and that, for a given temperature vaiation, the base-emitter junction voltage varies from 0.50 to 0.51 volts while the zener voltage varies from 4.500 volts to 4.501 volts. Looking at equation (2), output voltage in FIG. 1 increases from 5.0 to 5.1 volts while the output voltage of the circuit in FIG. 3, according to equation (12), varies from 5.000 to 5.011 volts. Thus, the circuit in FIG. 3 is considerably more stable over a wide range of temperature variations than that in FIG. 1. As will also be apparent, the zener diode 50 in FIG. 3 is selected with a voltage drop which is close to the required output voltage minus the base-emitter voltage (i.e., $V_{zener} = V_{out} - .5$).

The circuit in FIG. 3 is also more responsive (i.e., it has greater loop gain). In FIG. 1 the voltage divider comprising resistors 34 and 42 attenuates any output voltage variation. On the other hand, wiper arm 54 is positioned so that $R_{52a} = R_{52}$, no such attenuation occurs.

Since the zener diode is on the regulated side of the power supply, its current is held constant by the circuit operation. Under constant-current conditions, the internal resistance of the zener diode is not of major importance, as it is in conventional regulating circuits. This allows operation of the zener diode at far less than its rated current, further conserving battery power. In a typical application, the zener diode, which was rated at 20mA, operated in this circuit with only 50 $\mu$A of current.

By way of example, the regulator in FIG. 3 has been constructed with the following components:

| | |
|---|---|
| Battery 10 | 9 volt |
| Field Effect Transistor 22 | 2N5485 |
| Transistor 28 | 2N4124 |
| Resistor 30 | 220 kilohms |
| Zener diode 50 | 1N4734A |
| Potentiometer 52 | 100 kilohms |

This regulator produces a five-volt output voltage (i.e., $V_{out}$ = 5v.). Furthermore, it maintains this regulated voltage until the battery voltage drops to 5.15 volts (i.e., the output voltage plus the minimum drop across the source and drain electrodes at point C on the characteristic curves in FIG. 2).

Figure 4:
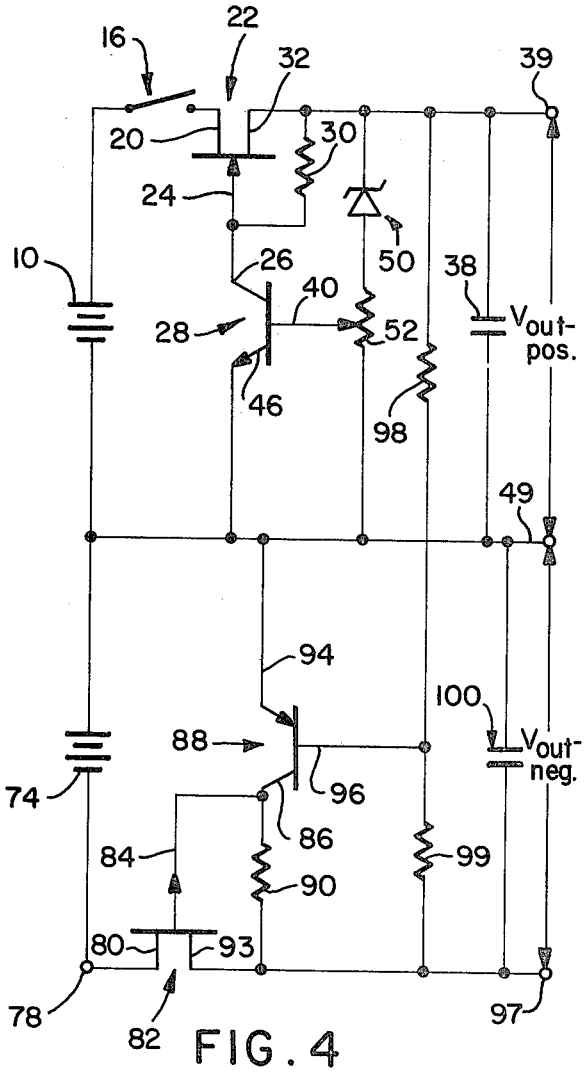
FIG. 4 is a schematic diagram of a voltage regulator using the types shown in FIGS. 1 and 3 for producing both positive and negative regulated *d-c* output voltages.

In other applications it may be desirable to obtain both positive and negative regulated output voltages. FIG. 4 illustrates how the circuits in FIGS. 1 and 3 might be interconnected to provide a stable regulator circuit. Specifically, the circuit of FIG. 3 is repeated in FIG. 4 and produces the positively biased output voltage $V_{out\text{-}pos}$ between terminals 39 and 49. A second battery 74 has its positive terminal connected to the common input terminal 49 and a negative terminal 78 for connection to the drain electrode 80 of a P-channel depletion field effect transistor 82. A gate electrode 84 connects to the junction of a collector electrode 86 in a PNP transistor 88 and a collector resistor 90 analogous to the collector resistor 30. An emitter electrode 94 connects to the common terminal 49 and the base electrode 96 is coupled to a voltage divider between the output terminals 39 and 97. The voltage divider comprises resistors 98 and 99. The junction of the resistors 98 and 99 is a tap connection for the base electrode 96. A load ripple compensating capacitor 100 analogous to the capacitor 38, may be connected across the output terminals 49 and 97.

The voltage $V_{out\text{-}neg}$ between the terminals 49 and 97 "tracks" the voltage $V_{out\text{-}pos}$ between the terminals 49 and 39. Resistors 98 and 99 can be selected so that both output voltages are equal. If the output voltage $V_{out\text{-}pos}$ were to increase, the resistors 98 and 99 would act to decrease the base current in transistor 88 and thereby decrease the current through the resistor 90. This increases conduction through the field effect transistor 82 and the output voltage $V_{out\text{-}neg}$ increases in magnitude.

Thus, in summary, the voltage regulators in FIGS. 1, 3 and 4 are all adapted for use with any varying d-c source, but are especially adapted for use with battery sources. In all three circuits unregulated input voltage can be reduced below the minimums which were acceptable in circuits using transistors as series regulating elements. Furthermore, even where the zener diode 50 serves as part of a reference voltage supply circuit with the PN, or diode, junction defined by the base-emitter junction of the transistor 28, the power the regulator requires is small. Thus, the regulator can operate very efficiently. It is an object of the appended claims to cover all variations and modifications which are within the true spirit and scope of this invention.

What is new and desired to be secured by Letters Patent of the United States is:

1. A circuit for producing an output voltage, $V_{out}$, that is independent of variations of an input voltage and that varies predictably in response to changes in ambient temperature under constant load conditions, said circuit comprising:

A. a common conductor,

B. an input terminal for coupling, with said common conductor, the input voltage to said circuit, C. an output terminal for coupling, with said common conductor, the output voltage from said circuit, D. a series regulating, junction-type field effect transistor having a gate electrode, a drain electrode connected to said input terminal and a source electrode connected to said output terminal, E. control means connected only to said output terminal and said common conductor, said control means including:

i. voltage divider means connected to said output terminal and said common conductor and including a tap connection, the voltage at said tap connection being $AV_{out}$ where A is a constant, ii. transistor means including a collector-emitter current path in circuit between said gate electrode and said common conductor and a base-emitter current path including a base-emitter diode junction connected to said tap connection, the temperature of said diode junction being the ambient temperature and said diode junction being forward biased by the voltage at said tap connection, the voltage across said diode junction being $V_{be}$ and the current through said diode junction controlling the conductivity of said collector-emitter current path, and iii. a constant-current source connected to said output terminal as the sole source of current to said collector-emitter current path, all the current from said constant-current source passing through said collector-emitter path and the output voltage from said circuit being $V_{out}=V_{be}/A$ wherein the voltage across said forward biased diode junction, $V_{be}$, and therefore the output voltage $V_{out}$, vary predictably in accordance with the ambient temperature.

2. A circuit as recited in claim 1 wherein said voltage divider means comprises first and second resistors connected in series between said output terminal and said common conductor, the junction of said resistors constituting said tap connection.

3. A circuit as recited in claim 1 wherein said transistor means comprises an NPN transistor with a collector electrode connected to said constant current source and said gate electrode, a base electrode connected to said tap connection and an emitter electrode connected directly to said common conductor.

4. A circuit as recited in claim 1 wherein said field effect transistor is characterized by a pinch-off region which exists when the voltage between said source and drain electrodes exceeds a known pinch-off voltage and said circuit operates so the source-to-drain voltage exceeds the pinch-off voltage, said constant current source consisting of a resistor connected between said source and gate electrodes.

* * * * *